United States Patent [19]

Michelson

[11] 4,062,536

[45] Dec. 13, 1977

[54] DOCUMENT AIR VALVE

[75] Inventor: Gunnar P. Michelson, Van Nuys, Calif.

[73] Assignee: NCR Corporation, Dayton, Ohio

[21] Appl. No.: 723,694

[22] Filed: Sept. 16, 1976

[51] Int. Cl.[2] ..... B65H 29/24

[52] U.S. Cl. ..... 271/177; 271/195; 271/209

[58] Field of Search ..... 271/177, 195, 211, 272, 271/209

[56] References Cited

U.S. PATENT DOCUMENTS

| | | | |
|---|---|---|---|
| 949,935 | 2/1910 | Maxson | 271/177 |
| 3,161,278 | 12/1964 | Buccicone | 271/211 X |
| 3,260,519 | 7/1966 | Coleman, Jr. | 271/272 X |
| 3,323,645 | 6/1967 | Hori et al. | 271/177 X |
| 3,606,312 | 9/1971 | Mens et al. | 271/177 |

FOREIGN PATENT DOCUMENTS

| | | | |
|---|---|---|---|
| 1,931,208 | 2/1971 | Germany | 271/195 |

*Primary Examiner*—Robert W. Saifer
*Attorney, Agent, or Firm*—J. T. Cavender; Wilbert Hawk, Jr.; George J. Muckenthaler

[57] ABSTRACT

A header member containing an air chamber is positioned above each pocket of a document sorter, the air chamber having an upwardly directed inlet port and a plurality of downwardly directed outlet ports downstream of the inlet port. An air supply nozzle is positioned below the inlet port to blow air into the air chamber, the air then flowing out of the chamber through the outlet ports. The supply of air into the chamber is interrupted when a document passes between the inlet port and the supply nozzle, and the air flow is resumed when the document passes the inlet port, the air flowing from the outlet ports blowing the document downwardly, out of the path of the succeeding document, and into the pocket of the document sorter.

11 Claims, 7 Drawing Figures

DOCUMENT AIR VALVE

BACKGROUND OF THE INVENTION

In document sorters, the speed of processing the documents has reached a level wherein it is essential that each and every document be under the control of various apparatus and devices at substantially all times during the travel of the documents from the hopper to the pocket. In these business machines, it is well known that checks, deposit slips, and the like are separated or sorted into the bins or pockets at the end of such travel and since the checks or deposit slips vary in size, shape and thickness, the handling equipment must be able to rapidly, precisely, and accurately deliver the checks into the bin or pocket assigned for a particular bundle or packet of checks.

Representative prior art in document handling equipment is disclosed in U.S. Pat. No. 3,008,576, issued to W. J. Hanson et al., wherein a document feeding, sorting and stacking device includes document advancing belts having apertures therein for drawing a vacuum therethrough for maintaining the documents in contact with the belt, and a linkage and lever arrangement for directing the trailing edge of the document from the belt surface at the completion of the run. U.S. Pat. No. 3,787,044, issued to C. E. Lorensen et al., discloses document controlled picking and feeding apparatus wherein the document acts as a valve by closing openings in a stationary suction roller to cause a document feed cycle to be initiated during which the document is lifted and then driven until it is delivered from suction roller contact.

SUMMARY OF THE INVENTION

The present invention relates to document sorting and more particularly to control mechanism for positioning each document in a manner to provide a clear and unobstructed path for each succeeding document. A succession of such documents are caused to be driven along a pathway in upright or on long edge manner rearward of a plurality of bins or pockets with diverting means at each pocket to select documents from such succession of same and to direct the documents into the desired pockets. Means is also provided after the diverting operation for changing the attitude of each document from the upright position to a horizontal or flat position prior to being deposited in a respective pocket. As each document is caused to be driven into its respective pocket, it is necessary that the document be speedily placed or positioned therein so as not to interfere with a succeeding document, i.e. the trailing edge of one document must be out of the path of the leading edge of the next document that is selected to be deposited in the same pocket.

The mechanism of the present invention is directed to means for controlling the position and attitude of each document or check to be pocketed wherein a header member is positioned above each pocket and a supply of air is directed upwardly into the header member. The header member includes an air chamber having essentially an upwardly directed inlet port, located in the vicinity of the pocket entrance, downwardly directed outlet ports positioned downstream from the inlet port and means for efficiently redirecting the air flow within the air chamber. Below the header member, in juxtaposition to the inlet port of the header member, is located an air supply nozzle which blows a stream of air into the air chamber. As a document passes between the air supply nozzle and the inlet port, such document acts as a valve to control the air flow which in turn controls the attitude and position of the document.

More particularly, when the leading edge of a document passes the inlet port of the header member, the document will be lifted against the bottom of the header member and will prevent air flow through the air chamber. Therefore, while moving toward the pocket, the document will stay in very close proximity to the bottom surface of the header member. This attitude of the document will continue until the trailing edge of the document passes the inlet port. The instant the document passes the inlet port, the air flow through the air chamber will be resumed and the jets of air emanating from the outlet ports of the header member will blow the document downwardly, with emphasis on its trailing edge. Thus, when the next document arrives, such document again cuts off the air supply and, therefore, is moved in close vicinity to the bottom of the header member, the trailing edge of the preceding document having been moved farther donwstream and out of the way of the leading edge of the succeeding document.

The outlet ports of the air chamber could be formed, e.g., as a plurality of holes, or as a narrow, long, centrally located and longitudinally-oriented slot, or a combination thereof. The size of the holes need not be equal, nor their spacing uniform, nor the width of the slot be uniform. Rather, all these dimensions should be tailored so as to achieve maximum effect in moving the trailing edge of the document out of the path of the leading edge of the succeeding document.

The header member and the frame of the sorter and the guides in the vicinity of the air supply nozzle are shaped so as to cause the lateral edges of the document to be curved upwardly when the document enters the pocket. This is a measure to impart longitudinal stiffness to the document for the purpose of reducing the magnitude of uncontrolled motions of the document caused by aerodynamic forces acting on the document in conjunction with internal stresses in the document and deformations thereof. By arranging all ports at or close to the average longitudinal centerline of the documents, the duration during which the documents stay curved, and therefore longitudinally stiff, will be greatly increased as compared to a case where the documents are left alone after initial curving thereof. When a very thin and large document is being directed toward the pocket, a single row of outlet ports at the longitudinal centerline of the document may have too concentrated an effect, viz., the document may curve in V-shaped manner, and, while the center portion of the document is blown out of the way, its lateral edges may not be so effected. In this case a better curvature is obtained by laterally spreading out the outlet ports, e.g., by using two or more rows of such outlet ports, with the port diameters and lateral spacings chosen so as to achieve optimum curvature.

In order to minimize the aerodynamic losses in the air chamber, the inlet port of such chamber is shaped as a diffusor which reduces the air velocity thereby converting most of the kinetic energy of the inrushing air stream into a pressure rise. The redirecting of the air stream then takes place at a lower air velocity with a correspondingly lower pressure loss. At the outlet ports the pressure rise is reconverted into air velocity which, because of the low aerodynamic losses, is only slightly smaller than the air velocity at the air supply nozzle.

In view of the above discussion, the principal object of the present invention is to provide means for controlling the attitude and position of each check as it is routed into the sorter pocket.

Another object of the present invention is to provide pneumatic means directed at each check for causing the trailing edge thereof to be moved out of the path of a succeeding check.

An additional object of the present invention is to provide means in a document sorter for utilizing the document as a valve in the positioning of each document.

A further object of the present invention is to provide means for directing a column or flow of air so as to move the trailing edge of each document out of the path of a succeeding document.

Another object of the present invention is to provide means for directing a column or flow of air onto approximately the longitudinal centerline of the document so as to maintain a lateral curvature in the document for an extended period of time.

Additional advantages and features of the present invention will become apparent and fully understood from a reading of the following description taken together with the annexed drawings, in which.

Figure 2:
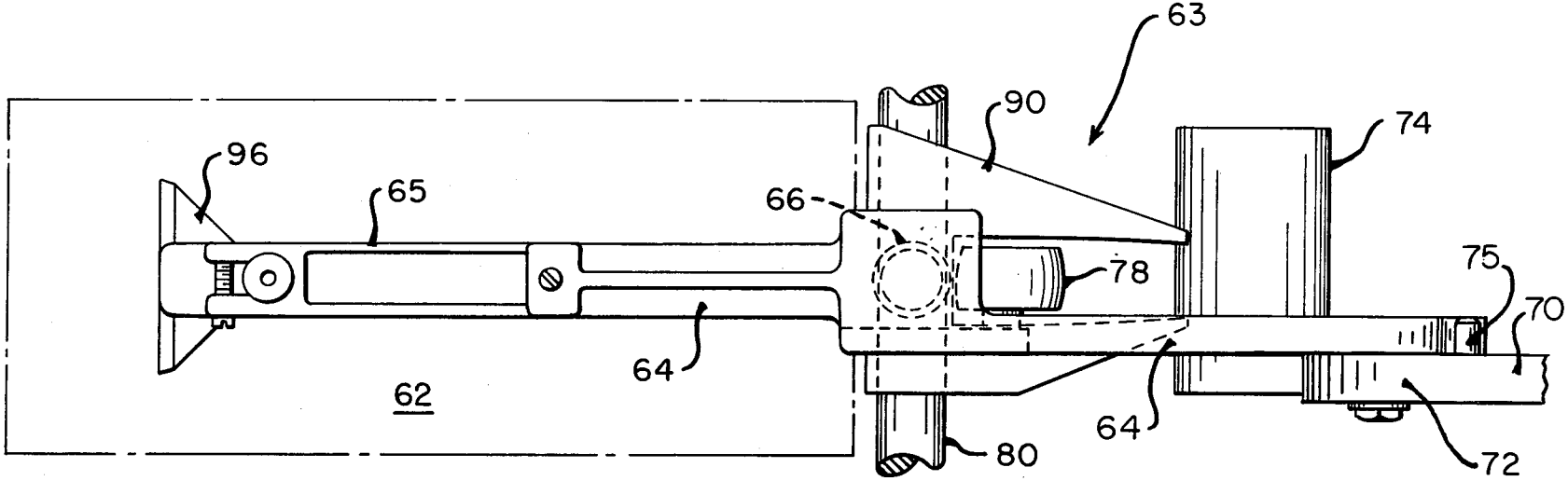
FIG. 2 is an enlarged plan view of apparatus for controlling flow of documents into the sorter pocket.
Figure 4:
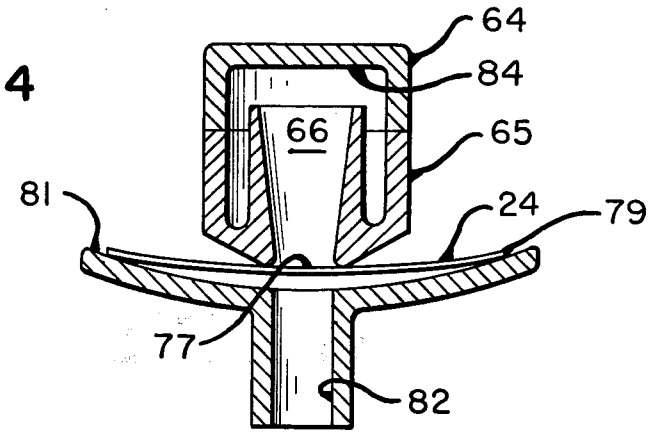
Figure 3:
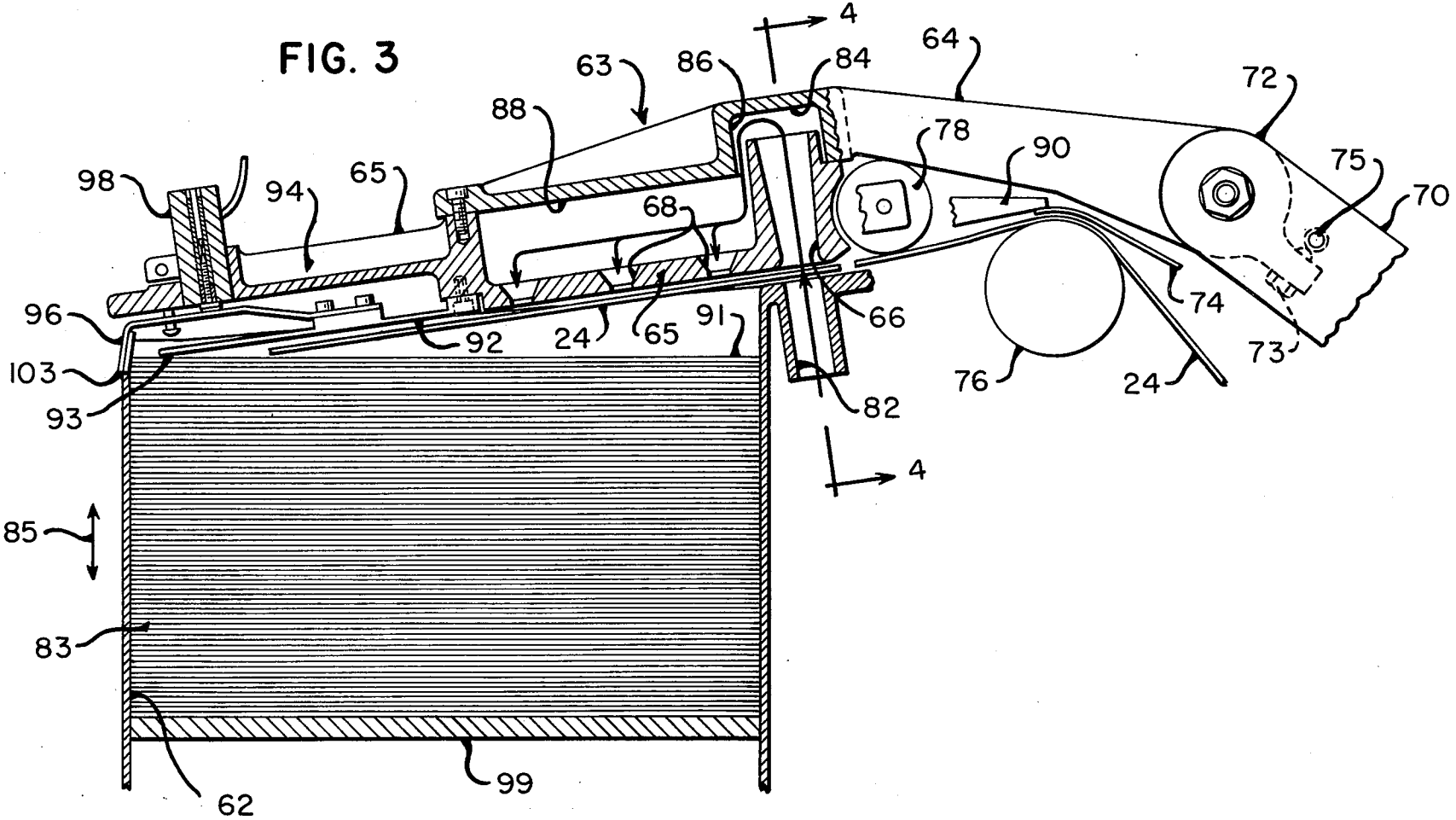
FIG. 3 is a side elevational view, partly in section, of the apparatus of FIG. 2 and showing a document in position to act as valve means during routing of the document to the sorter pocket.
Figure 5:
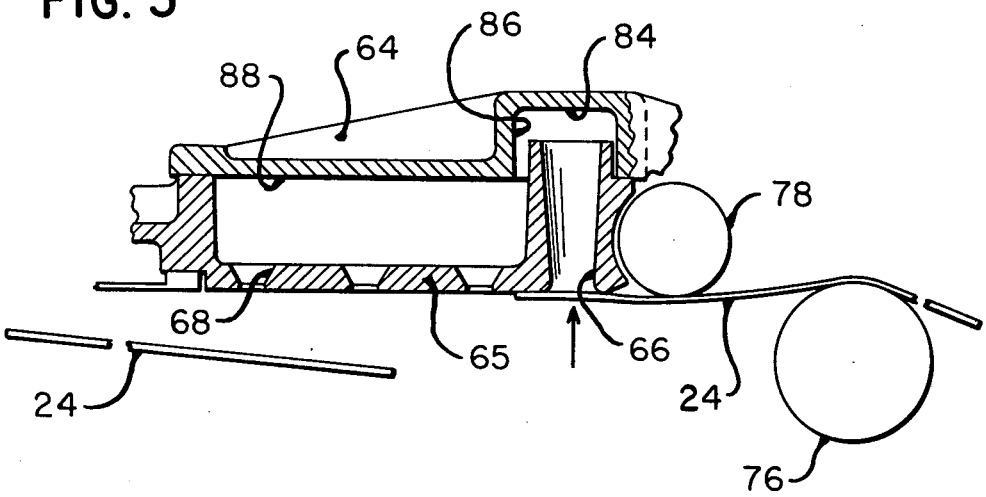
Figure 6:
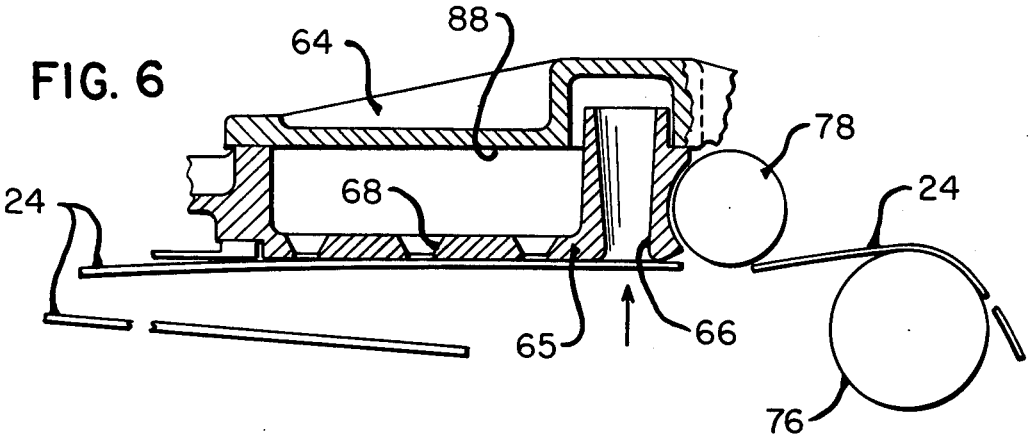
Figure 7:
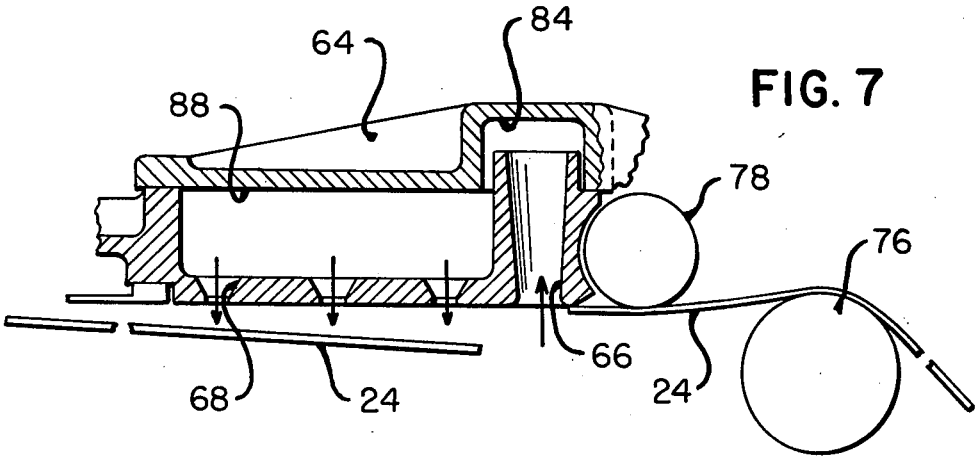

FIG. 4, on the sheet with FIG. 2, is a sectional view in elevation taken on the line 4—4 of FIG. 3;

FIG. 5, is a view, similar as a portion of FIG. 3, showing a document in position to be acted upon by the flow of air thereagainst;

FIG. 6 is a similar view as FIG. 5 showing the airflow against the document in further downstream travel; and FIG. 7 is a view further showing the position of the document being acted upon by the airflow.

Figure 1:
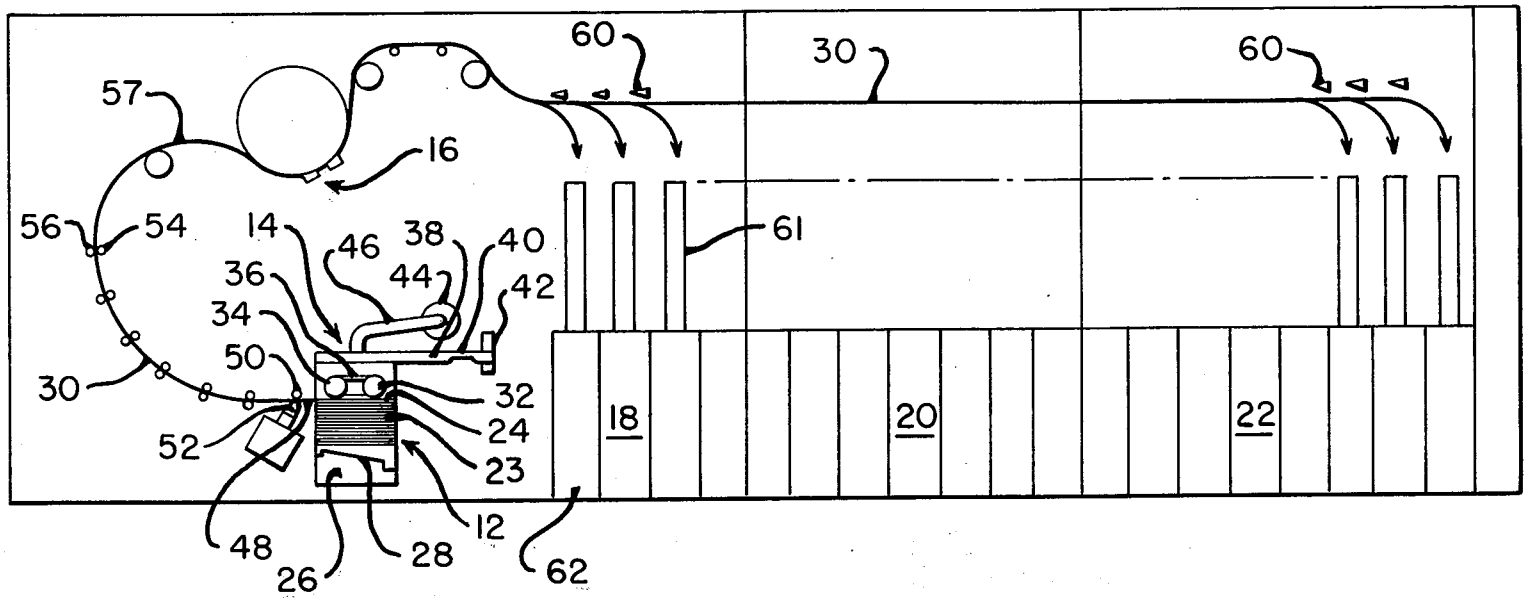
FIG. 1 is a plan view of document sorter apparatus incorporating the subject matter of the present invention.

Referring now to the drawing, FIG. 1 shows in plan view, in diagrammatic form, the arrangement of the various areas or sections of a document sorting machine, there being generally a hopper section 12, a feeder area 14, a read area 16 (a write or endorse area, if desired, may be adjacent or downstream of the read area) and stacking or pocket areas 18, 20 and 22. The document separating mechanism and the path of the documents beyond the separating mechanism include structures which are the subject matter of two co-pending applications, respectively, Ser. No. 723,693, filed Sept. 16, 1976, and Ser. No. 723,687, filed Sept. 16, 1976, and assigned to the same assignee as the present application. The pocket area 18 is a basic unit which may be utilized for limited operation and which may include, for example 1–6 pockets, the pocket area 20 being an add-on unit to provide more pockets, say a total of 12 pockets, and the pocket area 22 being a further add-on unit to provide still more pockets for the sorted checks or documents. The number of pockets, of course, will depend upon the extent of the operation desired or necessitated by the results to be obtained. Generally, these document sorters are set up in modular fashion wherein the number of pockets in each module may be a multiple of six, and wherein an extra pocket is provided at the end of the machine to accommodate those documents which are not selected for a particular pocket.

The hopper section 12 is set at an angle upwardly toward the feeder area 14, there being a stack 23 of documents 24 in the hopper 26. These documents are urged by an arm 28 (FIG. 1) upwardly at an angle toward the feeding mechanism which feeds each document into the document transport path 30 and toward the pocket area. The feed mechanism includes generally a pair of feed pulleys 32 and 34 with at least one belt 36 trained therearound, although the specific construction includes five belts around pulleys stacked to provide feed or drive means for each document. The feed mechanism is driven by an appropriate motor (not shown) and is supported in cantilever manner by means of an arm 38, having a reduced portion 40 for certain flexibility therein, and secured to the frame of the document sorter by a bolted bracket 42. Vacuum means in the form of a pump 44 and a hose 46 is utilized to draw the uppermost document 24 against the drive belts 36 so as to provide positive feeding of each document in successive manner.

As each uppermost document 24 is driven from the stack 23 thereof, it is directed toward and through a throat 48 formed by a drive wheel or roller 50 and an idler wheel or roller 52, the drive wheel 50 being the first of a plurality of drive members positioned along the document path 30 to maintain driving force on the documents 24 as they are successively transported toward the pocket area.

The documents 24 are caused to be transported in a vertical manner by drive rollers 54, idler rollers 56 and belts 57 along the path 30, as seen in FIG. 1, to the pocket areas 18, 20, or 22. Although the means for selecting the desired pocket for each document is not herein described, it is sufficient to say that upstream of the pockets and along the path 30 of the documents there are provided a plurality of gates 60 which are operated by means of stepping motors (not shown), actuated by appropriate electronic circuitry for directing the various documents into the pockets. Additionally, each document, as it is "gated" from the pathway 30, is caused to be reoriented from a vertical or upright attitude to a horizontal or flat attitude as it moves from the gate 60 to one of the pockets 62. This reorientation takes place in the intermediate transport portion 61. The pockets or bins 62 may be slanted downwardly toward the front of the sorter in well-known manner and each pocket or bin may have a capacity of a thousand documents or more.

In FIG. 2 is shown a top view of a header member 63 which is disposed generally rearwardly and above each of the pockets 62 for controlling each document as it is caused to be transported from the pathway 30 via the intermediate transport portion 61 to the respective pocket 62. The header member 63 consists essentially of an elongated top member 64 and an elongated bottom member 65 which are bolted together to form the air chamber passageways 84, 86, 88 (FIG. 3). The bottom member 65 has an upwardly directed inlet port 66, which may be shaped as a diffusor (see also FIG. 4), and a plurality of downwardly directed outlet ports 68, located downstream from the inlet port 66 and through a bottom portion of member 65. The top member 64 is mounted to the frame 70 of the sorter by means of a pivot 72 which permits pivotal up and down movement of the header member 63 for better access to the pocket 62 and to the intermediate transport portion 61 for removal of jammed documents. The position of the header member 63 is set by means of an adjusting screw 73 which is disposed at one end of the top member 64 and which rests, due to the weight of the header member, firmly against a stop 75 which is fixed to the frame 70 of the sorter. A center deflector 74 is positioned above a drive roller 76 for directing the document in a path toward the pocket 62. A guide or idler roller 78 is journaled just upstream of the opening 66 for placing the document in a correct elevation with respect to the bottom surface of the header member 63 wherein the document acts as a closure for the inlet port 66 as the document is directed therepast. A supply of air is provided through a manifold 80 (FIG. 2) which runs along the rear of the pockets 62 and has at each pocket an air supply nozzle 82 (FIGS. 3 and 4) positioned to direct air to the inlet port 66 at all times that the document sorter is sorting documents. The supply of air is directed upwardly through the inlet port 66, into the small chamber or passageway 84 and is then directed downwardly through the passageway 86 into a larger chamber 88 and through the outlet ports 68 to contact the surface of each document 24 as it is caused to be transported into the pocket 62. A deflector 90 is positioned rearwardly and partially surrounds the inlet port 66 to further guide the documents into position past the outlet ports 68. The deflectors 74 and 90 and the guide roller 78 are mounted to the top member 64 of the header member 63 so that they may be moved out of the way when the header member is pivoted upwardly.

In the range from roller 76 to the entrance of the pocket 62, the lateral edges 79 of the document 24 are gradually bent upwardly, as best seen in FIG. 4. The center portion 77 of the document 24 rests against the bottom surface of the bottom member 65 while its edges 79 are forced upward by the curved, sorter-fixed guides 81, which are designed so that the amount of curvature increases gradually in the aforementioned range.

In order to maintain the top document 91 of the document stack 83 at a level suited for pocketing documents (as shown in FIG. 3), a servo system is provided which moves the document stack 83 up or down as indicated by the double headed arrow 85. The servo system consists of a sensing spring 92 disposed at the forward portion 94 of the bottom member 65, a blade member 96 mounted to the sensing spring 92, a servo drive (not shown) which moves the bottom plate 99 and with it the document stack 83 up or down, and the associated electronics (not shown). The servo system operates in a manner that when documents are transported into the pocket 62, they are squeezed between the top document 91 of the document stack 83 and the front end 93 of the sensing spring 92 until they come to rest against the stop 103 adjacent the blade member 96. Since the header member 63 rests against the stop 75 and, therefore, cannot easily move, the sensing spring 92 is caused to be deflected upwardly by the uppermost document 24 which spring, in turn, actuates the sensor 98 via the blade member 96. The sensor then causes, by means of the servo drive (not shown), the bottom plate 99 to move downwardly until the top surface of the stack has returned to its original level. Although any conventional feedback servo system may be used for this purpose, it is advantageous, especially for long life, to use an alternating current system with a differential transformer as the sensor 98.

In FIGS. 5, 6, and 7 are shown the views of the path of a document 24 as it is caused to be moved past the drive roller 76 and the idler roller 78 toward the pocket 62. FIG. 5 shows one document 24 ready to be deposited in the pocket 62 and the position of the succeeding document 24 wherein the front or left portion thereof acts as a closure for the inlet port 66 and thereby shuts off the air supply to the inlet port, the direction of air movement urging the front portion of the document against the bottom surface of the bottom member 65. FIG. 6 shows the forward document 24 in a position where the rear portion of the document is closing off the airflow through the inlet port 66. Since there is no flow of air through the air chamber 88 at this time, the document will stay closely to the bottom surface of the bottom member 65 and adjacent the outlet ports 68. FIG. 7 shows the forward document 24 being acted upon by the movement of air being directed upwardly through inlet port 66 and downwardly through outlet ports 68 to urge the document into a position and path out of the path of the succeeding document which is in position to pass by the inlet port 66.

It is thus seen that herein shown and described is an apparatus in a document sorting operation wherein the apparatus includes a path for movement of air and wherein the movement of air is controlled by the position and travel of documents past the inlet and outlet ports of the apparatus. Such apparatus enables the accomplishment of the objects and advantages mentioned above, and while only one embodiment of the invention has been disclosed herein, variations thereof may occur to those skilled in the art. It is contemplated that all such variations, not departing from the spirit and scope of the invention hereof, are to be construed in accordance with the following claims.

What is claimed is:

1. Document control means for stacking documents in a pocket including means for driving said documents in the direction of said pocket, a passageway for guiding said documents in successive manner, an air chamber adjacent said passageway and pivotable in relation to said pocket and having entrance means and exit means downstream of said extrance means for flow of air through said chamber, means providing a continuous flow of air through said entrance means, the movement of a document past said entrance means interrupting the flow of air through said entrance means when passing thereby and after passing said entrance means permitting air to flow through said air chamber and out said exit means to move one document out of the path of a succeeding document, and sensing means responsive to the presence of documents in said pocket to maintain a level of documents therein.

2. The document control means of claim 1 including a plurality of juxtaposed pockets for receiving documents in selective manner, said air chamber comprising an elongated member associated with each of said pockets, and means for supplying air to each air chamber for controlling the attitude of each document upon deposition into a respective pocket.

3. The document control means of claim 1 wherein said entrance means comprises a cone-shaped diffusing aperture positioned adjacent said passageway for receiving and for distributing the flow of air to said exit means, and said exit means comprise a plurality of spaced cone-shaped apertures downstream of said entrance means for directing a document downwardly from said air chamber upon exit of air therefrom.

4. The document control means of claim 1 wherein said air chamber includes an elongated member having an upstanding inlet portion, a passageway over said inlet portion and connected therewith the directing the flow of air forwardly and downwardly toward said exit means, and a generally rectangular outlet portion for distributing the flow of air substantially over a document.

5. In document sorting apparatus, hopper means, feed and separating means for initiating flow of documents from said hopper means in singular manner, drive means for transporting documents along a predetermined path, a plurality of pockets, and means for selecting documents from said path for distribution to said pockets, the improvement comprising means for stacking the selected documents in said pockets in successive manner, air supply means providing a continuous flow of air, an air chamber pivotable in relation to each pocket and operably associated with said air supply means and having air entrance means and air exit means downstream of said entrance means for flow of air through said air chamber for controlling the attitude of documents entering said pockets, each document being urged by said air supply means against said entrance means and interrupting the flow of air therethrough upon passing said entrance means, and after passing thereof being subjected to the flow of air through said exit means to urge the document downwardly out of the path of a succeeding document, and sensing means responsive to the presence of documents in said pocket to maintain a level of documents therein.

6. In the apparatus of claim 5 including a plurality of adjacent pockets for receiving documents in selective manner, said air chamber comprising an elongated member pivotably associated with each of said pockets, and means for supplying air to each air chamber for controlling the attitude of each document upon deposition into a respective pocket.

7. In the apparatus of claim 5 wherein said entrance means comprises a cone-shaped diffusing aperture positioned upwardly from said air supply means for receiving and for distributing the flow of air to said exit means, and said exit means comprise a plurality of spaced cone-shaped apertures downstream of said entrance means for directing a document downwardly from said air chamber upon exit of air therefrom.

8. In the apparatus of claim 5 wherein said air chamber includes an elongated member having a cone-shaped upstanding inlet portion, a passageway over said inlet portion and connected therewith for directing the flow of air forwardly and downwardly toward said exit means, and a generally rectangular outlet portion having cone-shaped apertures for distributing the flow of air substantially over the document.

9. In the apparatus of claim 5 including guide means for laterally bowing and curving the side edges of each document upwardly at the time of passing said entrance means and said exit means.

10. In the apparatus of claim 5 wherein said sensing means includes a differential transformer.

11. In the apparatus of claim 5 wherein said air chamber includes an elongated member and said air entrance means comprises a cone-shaped aperture diffusing the flow of air upwardly, a passageway for directing the flow of air forwardly and downwardly from said aperture toward said exit means, and said exit means comprise a plurality of spaced cone-shaped apertures for distributing the flow of air substantially over the document.

* * * * *